United States Patent [19]

Stascavage et al.

[11] 4,120,340

[45] Oct. 17, 1978

[54] CLOSURE

[75] Inventors: John A. Stascavage, Exeter; William W. Rawls; Alexander Buchholz, both of Mountaintop, all of Pa.

[73] Assignee: Cornell Iron Works, Inc., Mountaintop, Pa.

[21] Appl. No.: 850,089

[22] Filed: Nov. 8, 1977

[51] Int. Cl.[2] ..... E06B 9/08

[52] U.S. Cl. ..... 160/133

[58] Field of Search ..... 160/133, 116, 114, 32, 160/25

[56] References Cited

U.S. PATENT DOCUMENTS

| | | | |
|---|---|---|---|
| 1,352,656 | 9/1920 | Cahill | 160/133 X |
| 2,592,888 | 4/1952 | Greegor | 160/133 X |
| 2,898,988 | 8/1959 | Zoll | 160/133 X |
| 3,601,175 | 8/1971 | Wardlaw | 160/133 |
| 3,850,465 | 11/1974 | Hill et al. | 160/133 |

*Primary Examiner*—Philip C. Kannan

*Attorney, Agent, or Firm*—Emory L. Groff, Jr.

[57] ABSTRACT

A closure includes a rolling grille of the glazed type. A plurality of rods are pivotally retained in parallel, spaced-apart relationship by a plurality of strings of link assemblies. Each link assembly is formed by two identical link elements journaled upon adjacent rods in back to back relationship. A panel is disposed between each pair of adjacent rods and has its ends secured to attaching means integral with each link element. Ready fabrication and subsequent smooth quiet operation is assured by forming the link elements of a synthetic resin composition such as nylon plastic.

15 Claims, 5 Drawing Figures

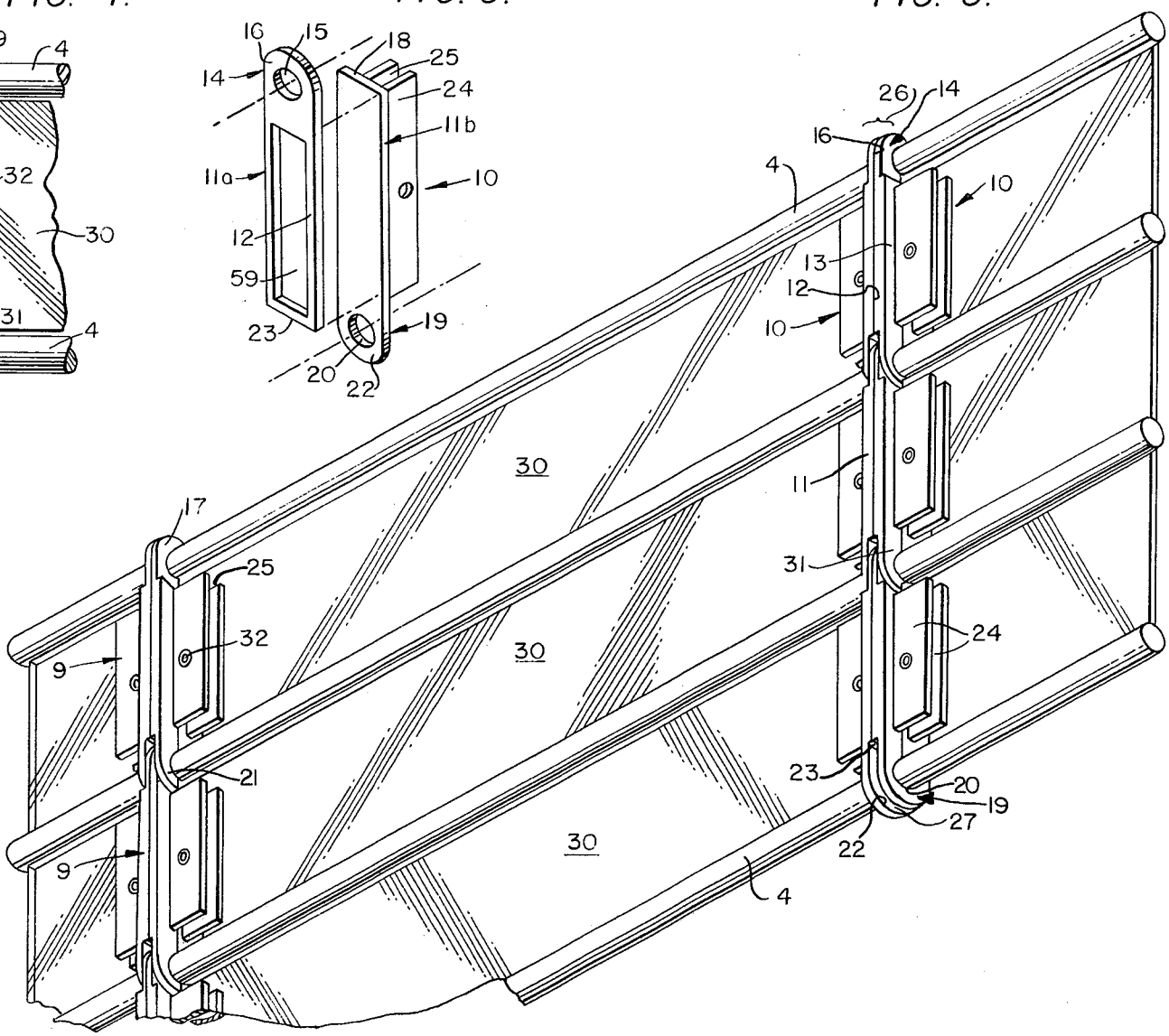
FIG. 3.
10
14
26
16
4
13
12
10
11
31
24
20
19
27
22
23
4
30
30
30
25
32
21
17
9
9
FIG. 5.
10
25
24
11b
18
15
16
14
11a
12
59
23
19
22
20
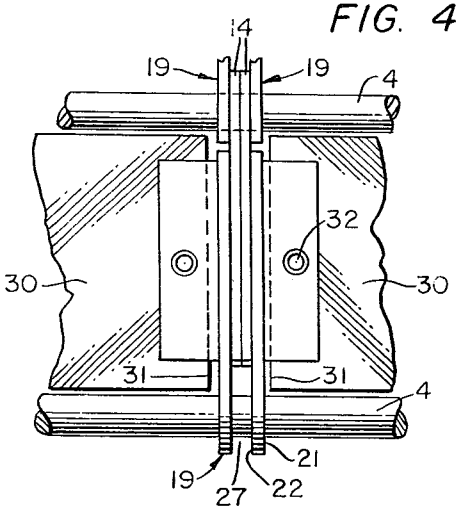
FIG. 4.
4
19
14
19
30
32
31
31
30
4
21
22
27
19

CLOSURE

This invention relates generally to closures and more particularly to a displaceable closure such as a rolling grille.

Rolling grilles comprising a plurality of parallel rods joined to one another by means of pivotal links have long been employed to offer a displaceable closure for a door opening. The popularity of these closures is noticeably on the up-swing particularly in view of the surge of construction of enclosed shopping malls wherein individual shops perfer a closure for their door openings which will provide security after regular business hours without sealing off visibility of the store interior to passersby.

By the present invention an improved grille construction is provided wherein the heretofore open area between each pair of adjacent grille rods is closed off by a clear or transparent panel. Unique link assemblies are provided for inter-connecting the plurality of longitudinal grille rods and at the same time provide the sole support and connection for the plurality of panels therebetween. By fabricating the link assemblies of a suitable synthetic resin composition, such as nylon plastic, numerous advantages are obtained. Improvements result in the cost and ease of fabrication of the links and the subsequent operation of the grille is vastly improved due to the reduced weight of the link assemblies and the inherent lubricity thereof.

Store owners will now find that by utilizing the instant glazed grille notably improved protection is achieved against damage due to fire, water or smoke in view of the substantially 100% barrier offered by the present invention without any sacifice of visibility therethrough. The primary objective of any rolling grille employed by store owners to close off a door opening is of course, security and the solution to this problem is even further enhanced by utilizing the present glazed construction since the inclusion of the panels provide a barrier precluding unauthorized passage of a person's arm or any foreign device between the grille rods and into the store interior.

Accordingly, one of the objects of the present invention is to provide an improved closure including a rolling grille comprising a plurality of spaced apart parallel rods joined to one another by series of strings of link assemblies and including individual panels between each adjacent pair of rods and link assemblies.

A further object of the present invention is to provide an improved glazed grille including a plurality of parallel rods joined to one another by a plurality of series of plastic link assemblies with each pair of laterally adjacent link assemblies retaining a panel therebetween.

Another object of the present invention is to provide an improved displaceable grille including a plurality of horizontal and parallel rods joined to one another by a plurality of strings of link assemblies slidably journaled about the rods with each pair of adjacent link assemblies rigidly retaining a panel therebetween.

Still another object of the present invention is to provide an improved rolling grille including a plurality of parallel rods joined to one another by series of intermeshed link assemblies with each link assembly comprising a pair of juxtaposed congruent link elements and each link element serves to support one end of a panel disposed between each pair of adjacent rods.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings, in which:

FIG. 3 is a partial perspective view of the displaceable grille shown in FIG. 1.

FIG. 4 is an enlarged front elevation of one of the link assemblies of the present grille.

FIG. 5 is an exploded perspective view of one form of one of the link elements of the link assembly of the present invention.

Similar reference characters designate corresponding parts throughout the several figures of the drawings.

Figure 1:
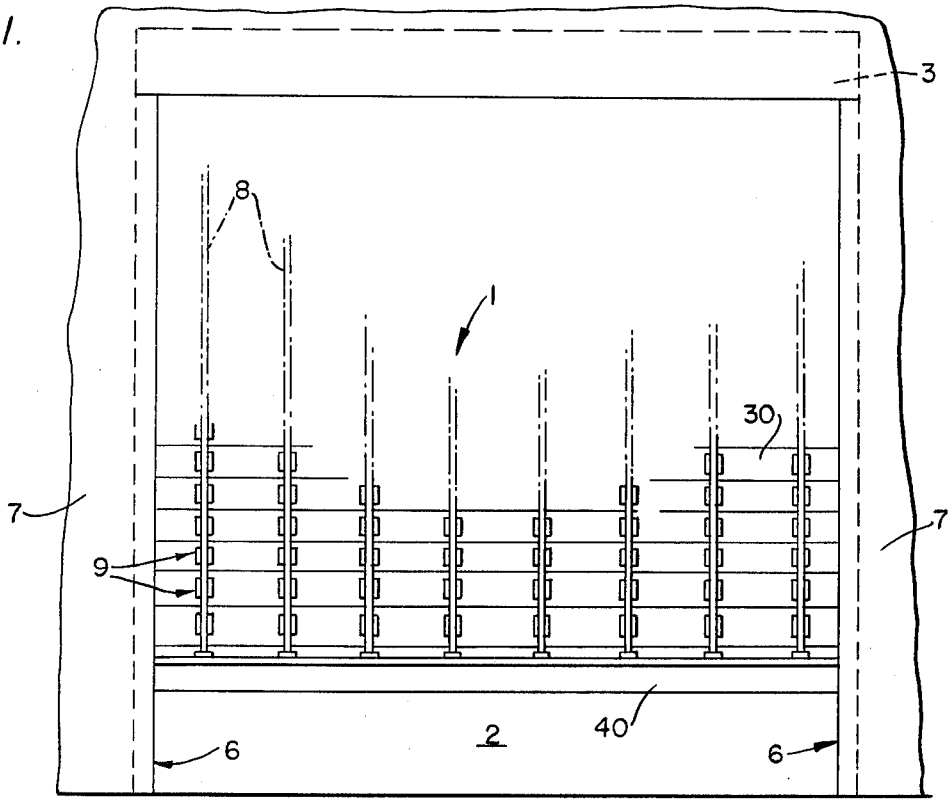
FIG. 1 is a front elevation of a closure according to the present invention.

Referring now to the drawings, particularly FIG. 1, the present invention will be seen to include a closure, generally designated 1, of the rolling grille type adapted to be selectively displaced from a position sealing off the door opening 2, to an alternate position allowing of free passage through the door opening. When in the open position, the grille 1 is adapted to be disposed within a suitable storage area 3 located adjacent to one of the edges of the door opening 2 and the specific structure for coiling the grille 1 or for selective displacement between its two alternate positions is purposely omitted inasmuch as this latter structure forms no part of the present invention.

The grille 1 comprises a plurality of transverse rods 4 spanning the extent of the door opening 2 and having their opposite distal portions 5—5 disposed within the respective edge guide members 6—6 mounted within the opposed walls 7—7 designating the door opening 2. The grille rods 4 are preferably cylindrical and are provided with a smooth periphery for reasons for which will become obvious hereinafter. The rods 4 are retained in the illustrated parallel spaced apart relationship by means of a plurality of series or strings 8 of link assemblies, generally designated 9. The construction of each of the link assemblies 9 will be most readily apparent from a review of FIGS. 3–5 wherein it will be seen that each link assembly comprises a pair of link elements 10–10 of identical or congruent construction.

As previously mentioned, the link elements 10 are preferably constructed of a synthetic resin composition such as nylon plastic and this feature lends itself to ready fabrication of the link elements as well as facilicates the subsequent assembly thereof and further enhances the smooth, quiet operation of the closure between its alternate positions. Each link element 10 includes a main body 11 having planar inner and outer faces 12 and 13, respectfully. Projecting from one end of the main body 11 is a tongue segment 14 provided with a transverse opening 15 of a dimension offering a close sliding fit with the periphery of the grille rods 4.

As shown most clearly in FIG. 3 of the drawings the tongue segment 14 is laterally offset with respect to the medial portion of the link element main body 11 such that the inner face 16 of the tongue segment 14 is co-planar with the inner face 12 of the main body 11 while the tongue segment outer face 17 is aligned with the medial portion of the main body 11 and intersects therewith to provide a shoulder 18.

Looking at the opposite, lower end of each link element 10 it will be seen that the main body 11 extends downwardly in the form of groove segment 19 which likewise includes a transverse opening 20 offering a close sliding fit with the grille rods 4. This groove segment 19 includes an outer face 21 which is co-planar with the outer face 13 of the main body 11 on the one hand, and includes an inner face 22 extending from the medial portion of the main body 11 and forming a shoulder 23 at the intersection therewith. Projecting away from each main body outer face 13 are a pair of spaced apart parallel flanges 24—24 which are spaced apart from one another to provide a channel 25, the width of which is substantially less than the diameter of the grille rods 4.

Figure 2:
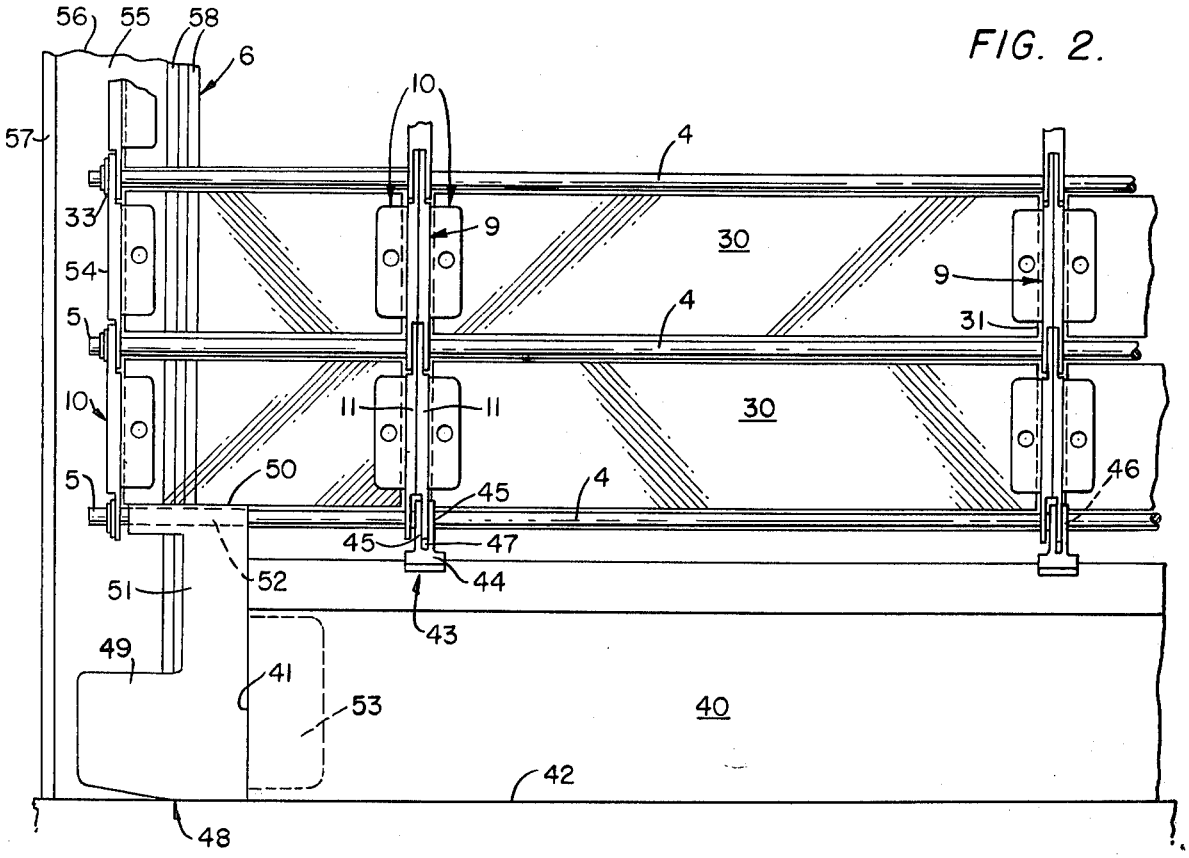
FIG. 2 is a fragmentary front elevation illustrating the lower left hand corner of the grille shown in FIG. 1.

With the foregoing construction in mind, it will now be seen that each of the link assemblies 9 is made up of a pair of identical link elements 10—10 which are assembled upon a pair of parallel rods 4—4 so that the two tongue segments 14 of the two link elements engage the same rod 4 while the two groove segments 19 of the two link elements engage the next adjacent grille rod 4 and when the two link elements are moved into abutting relationship the inner faces 12 of the two elements will be juxtaposed along with the inner faces 16 of the tongue segments 14 of the two link elements. As shown in FIGS. 2-4, the assembly 9 formed by the thus positioned pair of link elements offers a unitary tongue 26 at the upper end thereof. Each tongue formation 14 and groove segment 19 is of identical thickness and it will thus follow that the resultant tongue 26 will be of identical thickness to the width or thickness of the formed groove 27 at the opposite end of the link assembly so that it will be apparent that a close fit will result when the tongue 26 of the link assembly is disposed within the groove 27 formed by the end of an adjacent link assembly 9 thereby precluding undesirable side play between adjacent link assemblies.

The glazed feature of the present invention is achieved by mounting a panel 30, which may be constructed of any suitable clear or transparent material, between laterally opposed link elements 10—10 with respective end edges 31—31 of each panel 30 disposed between the two flanges 24—24 of each link element and retained therein by means of a suitable fastener 32 mounted through the opposed flanges 24 and ends of the panel 30.

Actual assembly of the instant grille 1 is most readily achieved by the initial attachment of a pair of link elements 10 to the two ends of a panel 30 after which the sub-assembly is slipped over the distal portions 5 of two adjacent parallel grille rods 4. From a review of the drawings it will be seen that the assembly of all of the panels 30 of the grille 1 may be readily achieved by starting with the installation of one string 8 of link assemblies with attached panels 30 upon the uppermost grille rods 4. The next assembly step would involve installation of another series of panels 30 with attached link elements 10 from the bottommost two grille rods 4 and proceeding upwardly to the topmost grille rods 4 and thereafter continuing the alternate downward and upward installation of the sub-assemblies until all of the series of link assemblies 8 and attached panels 30 have been installed.

In view of the inherent lubricity offered by the journaling of the grille rods 4 within the close fitting openings 15, 20 in the distal portions of the link assemblies it will be appreciated that suitable means is required to preclude lateral shifting of the mounted panels on the grille rods 4 during subsequent operation of the closure 1. Accordingly, a suitable stop member 33 is applied adjacent the distal portion 5 of each of the rods 4 and abuts the tongue segment 14 or groove segment 19 of the adjacent end-most link element 10 as shown in FIG. 2 of the drawings.

To facilitate the displacement of the grille 1 between its alternate positions and to enhance the security along the bottom thereof when in the closed position, a bottom bar 40 is disposed beneath the lowestmost one of the grille rods 4 as shown in FIGS. 1 and 2 of the drawings. This bar 40, preferably constructed of light-weight metal, extends transversely substantially the entire lateral extent of the door opening 2 with its outer edges 41—41 terminating just short of the edge guide members 6—6.

Suitable sealing or gasket means (not shown) may be carried by the undersurface of the bottom bar 40 to cooperate with the floor 42 when the grille is in its lowered or a closed position.

The bottom bar 40 is suspended beneath the lowestmost grille rod 4 by means of a plurality of bottom connecting link elements 43, one each associated with each of the series or strings 8 of link assemblies. As shown in FIG. 2 of the drawings each bottom connecting link element 43 includes a base 44 suitably attached to the upper portion of the bottom bar 40 and from which project upwardly a pair of flanges 45—45. These flanges are formed with laterally aligned holes 46 offering a close sliding fit with the bottom grille rod 4 and are spaced apart from one another to provide a groove 47 of sufficient lateral dimension to straddle one of the depending groove segments 19 of a lowermost link assembly 9 which is connected to the bottom grille rod 4.

More positive fixation of the outer or end edges 41 of the bottom bar 40 is achieved by means of the use of an end plug 48 comprising a main body 49 joined to an uppermost sleeve 50 by means of an intermediate web 51. The sleeve 50 includes a central bore 52 offering a close sliding fit with the distal portion of the lowestmost grille rod 4 while a tongue 52 projects inwardly from the end plug 48 and mates with the interior of the bottom bar 40 to form an attachment therewith. The end plug main body 49 is disposed within a vertical channel 55 formed within the edge guide member 6. This channel 55 is formed within each of the two edge guide members 6 by a pair of spaced apart side walls 56 extending from an end wall 57. One or more ribs 58 may project inwardly from the side walls 56 to further restrict the throat of the channel 55 and to allow only the passage of the end plug sleeve 50 and grille rods 4 therethrough.

Each link element 10 is illustrated in FIGS. 2 and 3 as being of unitary construction. Alternatively, the body 11 of each element 10 may be fabricated of separate inner and outer plates **11*a* and 11*b* respectfully, as shown in FIGS. 4 and 5. In this latter instance, the groove segment 19 will be seen to be a planar extension of the outer plate 11*b* while the tongue segment 14 is a planar extension of the inner plate 11*a*. The two plates are suitably joined to one another, such as by use of an adhesive or by heat bonding, such that an integral link element 10 is formed. To conserve weight and material the inner plate 11*a* may be provided with a medial cutout 59, overlying the juxtaposed portion of the outer plate 11*b*, as shown in FIG. 5**.

We claim:

1. A displaceable grille closure including, a plurality of parallel spaced apart rods, at leasttwo series of link assemblies joined to and maintaining said rods in said parallel relationship, each said series including a plurality of similar and axially aligned link assemblies, each said assembly having a tongue and a groove at opposite axial ends thereof and each provided with a transverse opening therethrough, said openings of said tongue and groove of adjacent said assemblies intermeshed and journaled about a common one of said rods, attachment means on each side of each said assembly and a panel having oposite end edges respectively connected to said attachment means of two laterally adjacent assemblies of said two series.

2. A grille closure according to claim 1 wherein, said rods are disposed horizontally and are provided with a smooth cylindrical periphery.

3. A grille closure according to claim 1 wherein, said link assemblies are non-metallic.

4. A grille closure according to claim 1 wherein, said panels are translucent.

5. A grille closure according to claim 1 wherein, said panels are transparent.

6. A grille closure according to claim 1 wherein, each said link assembly includes a pair of similar link elements disposed in back-to-back relationship.

7. A grille closure according to claim 1 wherein, said attachment means includes a pair of parallel flanges engaging opposite sides of each end of said panel, and fastener means disposed through said flanges and panel ends.

8. A grille closure according to claim 1 wherein, said panel substantially encloses the space between adjacent pairs of said rods and link assemblies.

9. A grille closure according to claim 2 including, a pair of vertical edge guide members spaced apart to define a door opening therebetween said guide members each provided with an inwardly directed channel, said rods having distal portions disposed respectively within said channels, and said end edge of said panels adjacent said guide members are disposed with said channels.

10. A grille closure according to claim 3 wherein, said link assemblies are of synthetic resinous composition.

11. A grille closure according to claim 6 wherein, each said link element includes a longitudinal main body having a tongue segment and groove segment extending from opposite ends thereof, said two segments laterally offset from the central longitudinal axis of said main body whereby, each said link assembly includes said tongue segments of a pair of said link elements justaposed to form said assembly tongue and said groove segments of said pair of elements are laterally spaced apart to form said assembly groove therebetween.

12. A grille closure according to claim 9 including, a bottom bar suspended from the lowestmost one of said rods and having outer edges disposed adjacent said guide members, an end plug affixed to each said bar outer edge and projecting into said guide member channel and means on each said end plug pivotally engaging said lowestmost rod.

13. A grille closure according to claim 11, wherein, said link element main body includes an inner plate substantially overlying an outer plate with said tongue segment projecting from one end of said inner plate and said groove segment projecting from one end of said outer plate.

14. A grille closure according to claim 13 wherein, said attachment means includes a pair of parallel flanges engaging opposite sides of each end of said panel, and said flanges are attached to said outer plate.

15. A grille closure according to claim 13 wherein, said inner plate includes a central cut-out overlying said outer plate.

* * * * *